United States Patent [19]

Northrop

[11] 4,056,027

[45] Nov. 1, 1977

[54] CUTTING DEVICE

[76] Inventor: Tom A. Northrop, 280 Alicia Way, Los Altos, Calif. 94022

[21] Appl. No.: 693,194

[22] Filed: June 7, 1976

[51] Int. Cl.[2] ..... B26D 7/02

[52] U.S. Cl. ..... 83/455; 83/456; 83/459; 83/614

[58] Field of Search ..... 83/455, 456, 458, 459, 83/614

[56] References Cited

U.S. PATENT DOCUMENTS

| | | | |
|---|---|---|---|
| 884,219 | 4/1908 | Scates | 83/459 |
| 912,212 | 2/1909 | Wade | 83/614 X |
| 2,013,893 | 9/1935 | Matthews | 83/455 |
| 3,513,744 | 5/1970 | Hershberger | 83/614 X |
| 3,532,018 | 7/1968 | Szabo | 83/455 |

*Primary Examiner*—Willie G. Abercrombie
*Attorney, Agent, or Firm*—Limbach, Limbach & Sutton

[57] ABSTRACT

A device for cutting sheet material includes a pair of generally flat elongated members hingedly connected together for holding sheet material to be cut and a cutting block supported for sliding movement on an upper such holding member and having an upper portion extending across the upper holding member with side portions extending downwardly from the edges of the upper holding member for guiding movement of the block longitudinally of the holding member. The cutting block includes a cutting blade affixed to one of the side portions of the block parallel to and between the side portion and the adjacent holding member longitudinal edge.

4 Claims, 4 Drawing Figures

CUTTING DEVICE

BACKGROUND OF THE INVENTION

This invention relates to devices for cutting sheet material and more particularly to devices for making straight, smooth cuts in sheet material.

The requirement for making straight, smooth cuts in sheet material has long existed and has been answered by apparatus ranging from a hand-held straight edge and knife combination to the familiar guillotine-type paper cutter to numerous other structures. Some of these structures, such as those of Tripp, U.S. Pat. No. 697,902, and Morrison et al, U.S. Pat. No. 614,407, have included the improvement of clamping the sheet material to be cut between a pair of straight edge members and then running a knife blade along the edge of those two members to effect a straight, smooth cut. However, these devices have suffered from a number of common deficiencies, relating both to effectiveness of operation and to safety. These deficiencies have included excessive exposure of a dangerously sharp cutting blade edge, difficulty in maintaining the desired alignment between the material to be cut and the cutting edge and a failure to support adequately the cutting blade to prevent deflection of the cutting blade away from the straight edge surface such as would tend to give an uneven cut.

SUMMARY OF THE INVENTION

It is an object of the present invention to provide a device for cutting sheet material which is both easy to use and relatively safe. It is another object of the invention to provide such a cutting device in which the cutting blade is held against a straight, guiding edge of a work holder and is supported against deflection away from that edge. It is yet another object of this invention to provide such a cutting device in which the alignment of the material to be cut relative to the cutting edge may be observed and maintained at all times during the cutting operation.

Briefly, this invention contemplates a device for cutting sheet material which comprises means for holding the sheet material to be cut. This holding means comprising a pair of generally flat, elongated members of substantially rigid transparent material hingedly connected together at one end with one such member above the other and with the longitudinally extending edges of the members parallel. A pin is provided at the opposite end of one such member projecting outwardly of the surface of that one member facing the other member and being receivable into a mating hole in the facing surface of that other member. Thus, reception of the pin into its mating hole may effect mutual centering of the two members when the mutually facing surfaces of the members are brought together. The device further comprises a cutting block supported for sliding movement on the upwardly facing surface of the upper holding member, this block having an upper portion extending across the upper holding member upwardly facing surface and having side portions extending downwardly of such surface and adjacent and parallel to the holding member longitudinally extending edges. These cutting block side portions extend downwardly to generally adjacent the downwardly facing surface of the upper holding member and serve to guide the movement of the block longitudinally of the holding member. The cutting block further includes a cutting blade affixed to a first such side portion parallel to and between that first side portion and the adjacent holding member edge, the cutting blade projecting below the downwardly facing surface of the upward holding member so that sheet material to be cut may be held between the facing surfaces of the holding members and aligned with the edge thereof by visual inspection through the transparent material and then may be cut or scored by moving the cutting block along the upper holding member with the blade contacting the sheet material while being guided by the holding member edge, thus to provide a straight line cut or score in the sheet material.

DESCRIPTION OF THE PREFERRED EMBODIMENT

Figure 1:
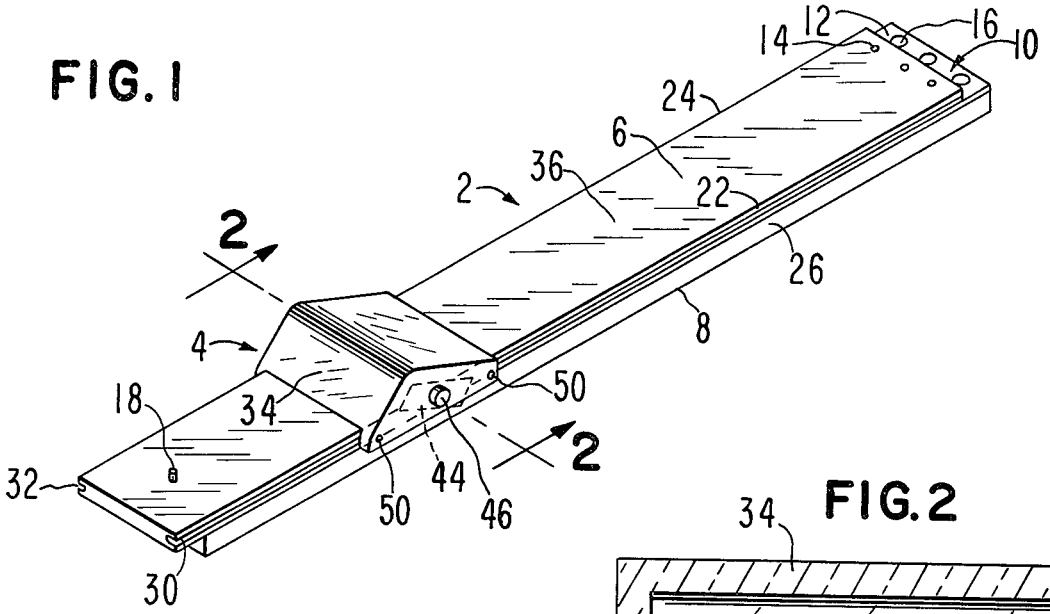
FIG. 1 is a perspective view of the cutting device of this invention with the hingedly connected holding members in the closed position.
Figure 2:
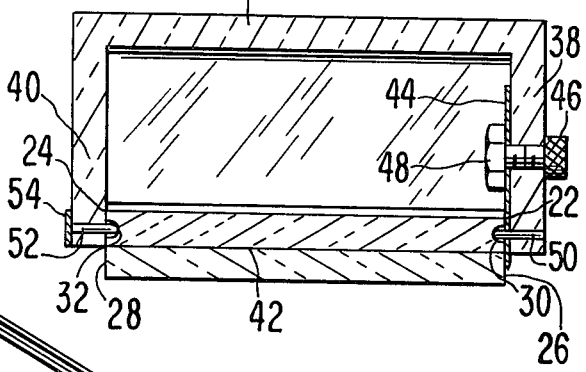
FIG. 2 is a sectional view of the cutting device of FIG. 1, taken along line 2—2 and illustrated in a larger scale for clarity.

In FIGS. 1–4, a preferred embodiment of the cutting device of this invention is illustrated. This device comprises two principal components, the material holding structure generally indicated by the numeral 2 and the cutting block generally indicated by the numeral 4. The holding structure 2 includes a generally flat, elongated upper holding member 6 made of substantially rigid, transparent material such as is sold under the name of Lucite. This upper member 6 is hingedly connected to a similar lower holding member 8 by means of a hinge 10 which comprises a member 12 of a resilient, synthetic resin, conveniently polyethylene sheet, connected to the upper and lower holding members 6 and 8 by a plurality of rivets 14 and 16, respectively. This resilient hinge 10 tends to urge the two holding members 6 and 8 into a mutually contacting relationship.

At the opposite end of lower holding member 8, a pin 18 projects upwardly of the surface of member 8 facing the upper mounting member 6. A mating hole 20 is provided in the corresponding portion of the upper holding member 6 to receive pin 18 when the members 6 and 8 are brought together, as seen in FIG. 1. Thus, when the members are brought together, the relative positions of the upper and lower members are fixed by the hinged connection and the engagement of the pin 18 thus to maintain the mutually parallel edges 22 and 24 of the upper mounting member 6 in parallel relation with the longitudinally extending edges 26 and 28 of the lower member 8. For purposes to be described below, it may be seen that longitudinally extending grooves 30 and 32 are provided in the edges 22 and 24 of the upper holding member 6.

The cutting block 4 of this device preferably is formed of a rigid, transparent material generally similar to that of the holding members 6 and 8. This cutting block 4 is supported for sliding engagement with the upper holding member 6 by the engagement of the block's upper portion 34 with the upwardly facing surface 36 of the holding member. Side portions 38 and 40 of the cutting block extend downwardly of the holding member surface 36 and are adjacent and parallel the edges 22 and 24 of that member. As may best be seen in FIG. 2, these cutting block side portions 38 and 40 extend down to generally adjacent the downwardly facing surface 42 of the upper holding member.

For cutting the sheet material of interest, a cutting blade 44 is affixed to the side portion 38 of the cutting block, parallel to and between the side portion 38 of the block and the adjacent upper holding member edge 22. As illustrated in both FIGS. 2 and 3, this cutting blade 44 projects downwardly below the surface 42 of the upper holding member 6. The blade 44 conveniently may be a sharp razor blade removably and adjustably affixed to the cutting block side portion 38 by means of a knurled screw 46 and nut 48.

Figure 4:
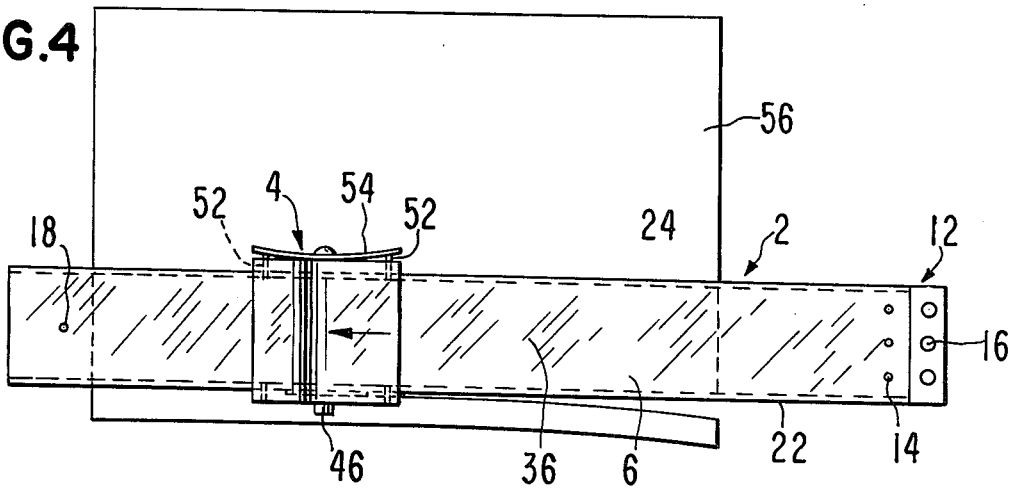
FIG. 4 is a plan view of the cutting device of this invention illustrating the manner of cutting a piece of sheet material therewith.

It may be seen from the above that sliding movement of the cutting block 4 with respect to the holding structure 2 is guided by the engagement, with a small clearance, of the upper portion 34 and side portions 38 and 40 of the cutting block 4 with their respective mating portions of the upper holding member 6. To provide additional positive guidance for the cutting block, grooves 30 and 32 are provided on the opposite, longitudinally extending edges of upper holding member 6. At least one, and preferably two pins 50 extending inwardly of the cutting block side portion 38 into the groove 30. Similarly, at least one, and preferably two pins 52 extend inwardly of the cutting block side portion 40 and into the groove 32 on the opposite side of the upper holding member 6. Preferably, the guide pins 52 when engaged with the slot 32 project outwardly of cutting block side portion 40 through clearance holes and are resiliently urged into the groove 32 by a suitable biasing means such as leaf spring 54, as best shown in FIG. 4 of the illustrations. This biasing arrangement not only urges the pins into the guide groove for guiding the cutting block during its sliding movement, but also urges the opposed cutting block side portion 38, and thus the blade 44, against the edges 22 and 26 of the holding structure. Thus, close engagement between the blade and the guide surface is provided to insure a smooth, straight cut of sheet material such as material 56 held between the holding members.

Figure 3:
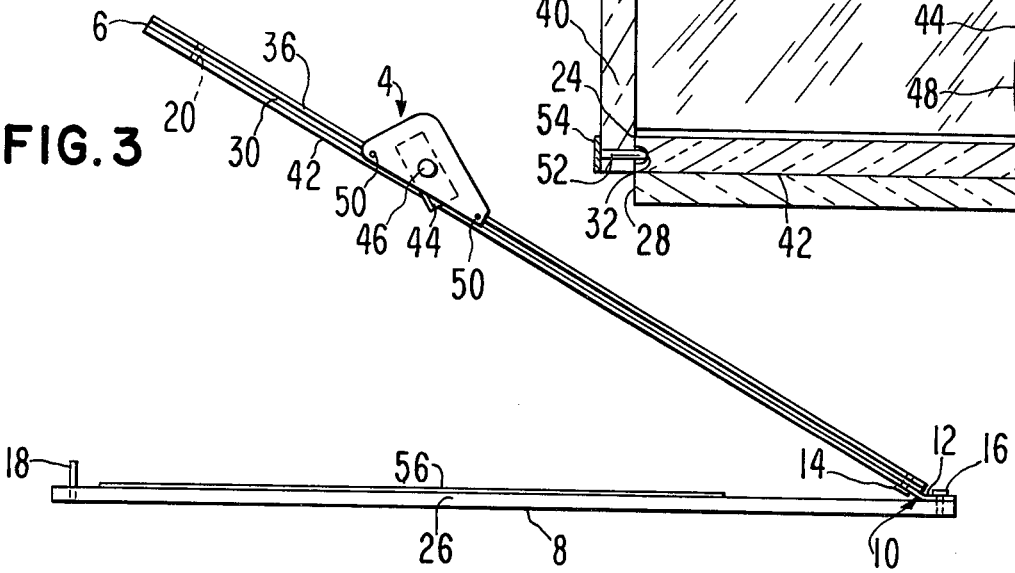
FIG. 3 is a side elevation of the cutting device of this invention with the hingedly connected holding members shown in the open position.

From the foregoing description, it may be seen that the manner of operation of this cutting device is as follows: the upper holding member 54 is pivoted upwardly about the hinge 10, as illustrated in FIG. 3, in order that a piece of sheet material 56 to be cut may be inserted between holding members 6 and 8. Cutting block 4 is then slid to a position adjacent hinge 10. Next, upper member 6 is lowered into position overlying sheet material 56, and the portion of the material 56 to be cut is aligned, by visual inspection through the transparent member 6, with the edge 22. Then, cutting block 4 is advanced from its position adjacent the hinge 10 along the holding member 6 to the opposite end thereof, adjacent pin 18. This advancement of the cutting block causes the blade 44 to slice (or score if the blade depth is so adjusted) the sheet material 56 along a line adjacent the holding member edge 22, with the transparent cutting block 4 providing for continuous visual observation of the alignment of the sheet material 56 with the edge 22 and cutting knife 44. By virtue of the blade holding arrangement, very little of the cutting edge of blade 44 is exposed, thus enhancing the safety of this device. Additionally, this blade holding arrangement effectively clamps the blade 44 between the holding member edges 22 and 26 and the cutting block side portion 38 during the cutting operation, thus supporting the blade against any deflection that might cause an improper cut.

While the foregoing illustrates a preferred embodiment of the invention, the description is to be considered as illustrative of the principles of the invention only and not to be limitative thereof. Since numerous variation and modifications, all within the scope of the invention, will readily become apparent to those skilled in the art, the scope of this invention is to be limited solely by the claims appended hereto.

What is claimed is:

1. A device for cutting sheet material, comprising means for holding the sheet material to be cut, said holding means comprising a pair of generally flat, elongated members of substantially rigid transparent material hingedly connected together at one end thereof, one said member above the other and with the longitudinally extending edges of said members being parallel, with a pin at the other end of one said member projecting outwardly of the surface of said one member facing the other said member and being receivable into a mating hole in the facing surface of said other member, whereby reception of the pin into its mating hole may effect mutual centering of the two members when the mutually facing surfaces of the members are brought together; and a cutting block supported for sliding movement upon the upwardly facing surface of the upper said holding member, said block having an upper portion comprising a member of transparent material extending across said upper holding member upwardly facing surface and having side portions extending downwardly of said holding member surface and adjacent and parallel said holding member longitudinally extending edges to generally adjacent the downwardly facing surface of said upper holding member for guiding movement of said block longitudinally of said holding member, said cutting block further including a cutting blade affixed to a first said side portion parallel to and between said first side portion and the adjacent said holding member edge, said cutting blade projecting below the downwardly facing surface of said upper holding member, whereby sheet material to be cut may be held between the facing surfaces of the holding members and aligned with the edge thereof by visual inspection through the transparent material and then may be cut or scored by moving the cutting block along the upper holding member with the blade contacting the sheet material while being guided by the holding member edge thus to provide a straight line cut or score in the sheet material, with the transparent cutting block upper portion providing for continuous observation of the alignment of that material during such cutting.

2. A device for cutting sheet material, comprising means for holding the sheet material to be cut, said holding means comprising a pair of generally flat, elongated members of substantially rigid transparent material hingedly connected together at one end thereof, one said member above the other and with the longitudinally extending edges of said members being parallel, with a pin at the other end of one said member projecting outwardly of the surface of said one member facing the other said member and being receivable into a mating hole in the facing surface of said other member, whereby reception of the pin into its mating hole may effect mutual centering of the two members when the mutually facing surfaces of the members are brought together; and a cutting block supported for sliding movement upon the upwardly facing surface of the upper said holding member, said block having an upper portion extending across said upper holding member upwardly facing surface and having side portions extending downwardly of said holding member surface and adjacent and parallel said holding member longitudinally extending edges to generally adjacent the downwardly facing surface of said upper holding member for guiding movement of said block longitudinally of said holding member, said cutting block further including a cutting blade affixed to a first said side portion parallel to and between said first side portion and the adjacent said holding member edge, said cutting blade projecting below the downwardly facing surface of said upper holding member, said upper holding member including a first groove extending along said longitudinally extending edge which is adjacent said cutting blade and said cutting block side portion adjacent said groove including at least one guide pin extending inwardly of said block side portion and into said groove, whereby sheet material to be cut may be held between the facing surfaces of the holding members and aligned with the edge thereof by visual inspection through the transparent material and then may be cut or scored by moving the cutting block along the upper holding member with the blade contacting the sheet material while being guided by the holding member edge thus to provide a straight line cut or score in the sheet material, with the engagement of said groove by said pin serving to maintain the proper positioning of the cutting block relative to the holding members and the sheet material being cut during the cutting process.

3. A cutting device according to claim 2 wherein said upper holding member further includes a second groove extending along the other said longitudinally extending edge and wherein said cutting block side portion adjacent said second groove includes at least one pin extending inwardly of said block side portion and into said groove.

4. A cutting device according to claim 3 further comprising biasing means urging said second-groove-engaging pins into resilient engagement with said groove, whereby said resilient engagement tends to urge the cutting block first side portion and thus the cutting blade against the holding member edge which includes the first groove.

* * * * *